US009743719B2

(12) United States Patent
Bevilacqua

(10) Patent No.: US 9,743,719 B2
(45) **Date of Patent: *Aug. 29, 2017**

(54) QUICK RELEASE BUCKLE

(71) Applicant: National Molding, LLC., Miami Lakes, FL (US)

(72) Inventor: Miguel A. Bevilacqua, New York, NY (US)

(73) Assignee: National Molding, LLC., Miami Lakes, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/721,416

(22) Filed: May 26, 2015

(65) Prior Publication Data

US 2015/0320148 A1 Nov. 12, 2015

Related U.S. Application Data

(63) Continuation-in-part of application No. 14/044,378, filed on Oct. 2, 2013, now Pat. No. 9,038,251.

(51) Int. Cl.

| | |
|---|---|
| ***A44B 11/25*** | (2006.01) |
| ***A44B 11/00*** | (2006.01) |
| ***A44B 11/26*** | (2006.01) |

(52) U.S. Cl.

CPC ..... *A44B 11/2592* (2013.01); *A44B 11/006* (2013.01); *A44B 11/266* (2013.01); *Y10T 24/45524* (2015.01); *Y10T 24/45529* (2015.01); *Y10T 24/45623* (2015.01); *Y10T 24/45628* (2015.01)

(58) Field of Classification Search

CPC . A44B 11/2592; A44B 11/266; A44B 11/006; Y10T 24/45524; Y10T 24/45628; Y10T 24/45623; Y10T 24/45529

USPC ..... 24/634, 614, 615, 629, 623, 635, 642, 24/645, 651, 616

See application file for complete search history.

(56) References Cited

U.S. PATENT DOCUMENTS

| | | | |
|---|---|---|---|
| 1,091,449 | A | 3/1914 | Westin |
| 1,459,673 | A | 6/1923 | Jabner |
| 2,522,790 | A | 9/1950 | Johnston |
| 3,200,463 | A | 8/1965 | Craven et al. |
| 4,413,357 | A | 11/1983 | Sacks |

(Continued)

FOREIGN PATENT DOCUMENTS

WO WO2015077395 A2 5/2015

*Primary Examiner* — Robert J Sandy
*Assistant Examiner* — Rowland Do
(74) *Attorney, Agent, or Firm* — Malloy & Malloy, P.L.

(57) ABSTRACT

A buckle assembly structured for quick release and including a gripping assembly structured to removably retain an end connector in a locked position. Two locking segments are movably connected to one another and disposable between a closed orientation and a release orientation. The locked position includes the locking segments disposed in gripping engagement with the connector when the connector is disposed between the locking segments. A quick release assembly may be selectively positioned into a separating engagement with the locking segments to at least partially define a positioning thereof from their closed orientation into their release orientation. A secondary release assembly is connected to the gripping assembly and is independently operable to release the connector from the gripping engagement with the locking segments.

18 Claims, 9 Drawing Sheets

(56) References Cited

U.S. PATENT DOCUMENTS

| | | | |
|---|---|---|---|
| 4,468,843 | A | 9/1984 | Duclos et al. |
| 4,507,802 | A | 4/1985 | Small |
| 4,673,070 | A | 6/1987 | Ambal |
| 4,774,724 | A | 10/1988 | Sacks |
| 5,644,792 | A | 7/1997 | Tishler et al. |
| 5,832,573 | A | 11/1998 | Howell |
| 5,978,961 | A | 11/1999 | Barker |
| 6,154,936 | A | 12/2000 | Howell et al. |
| 6,487,761 | B2 | 12/2002 | Van Tassel |
| 6,637,083 | B1 | 10/2003 | Howell |
| 6,678,925 | B1 | 1/2004 | Howell |
| 6,684,404 | B2 | 2/2004 | Backner, Jr. et al. |
| 6,685,071 | B2 | 2/2004 | Prather |
| 6,892,392 | B2 | 5/2005 | Crye et al. |
| 6,922,847 | B2 | 8/2005 | Bachner, Jr. |
| 6,961,957 | B2 | 11/2005 | Carlson |
| 7,007,352 | B1 | 3/2006 | Hill |
| 7,080,430 | B2 | 7/2006 | Wemmer |
| 7,155,786 | B2 | 1/2007 | Grimm |
| 7,251,867 | B2 | 8/2007 | Wemmer |
| 7,424,748 | B1 | 9/2008 | McDunn et al. |
| 7,448,116 | B1 | 11/2008 | Howell |
| 8,181,318 | B2 | 5/2012 | Anscher |
| 8,196,273 | B2 | 6/2012 | Anscher |
| 8,209,825 | B2 | 7/2012 | Carter |
| 8,353,065 | B1 | 1/2013 | Crye |
| 8,365,312 | B2 | 2/2013 | Herring |
| D677,433 | S | 3/2013 | Swan et al. |
| 8,490,212 | B1 | 7/2013 | Asher et al. |
| 8,490,256 | B2 | 7/2013 | Carter et al. |
| 8,522,410 | B2 | 9/2013 | Parisi et al. |
| 8,584,917 | B2 | 11/2013 | Hexels |
| 8,713,764 | B1 | 5/2014 | Rittenhouse et al. |
| 8,732,918 | B2 | 5/2014 | Carter |
| 9,003,947 | B1 | 4/2015 | Rittenhouse, Jr. |
| 9,038,251 | B1 | 5/2015 | Bevilacqua |
| 9,354,023 | B1 * | 5/2016 | Rittenhouse, Jr. ..... F41H 1/02 |
| 2002/0092140 | A1 | 7/2002 | Van Tassel |
| 2008/0263737 | A1 | 10/2008 | Parks et al. |
| 2009/0117300 | A1 | 5/2009 | Thompson |
| 2009/0277936 | A1 | 11/2009 | Rogers et al. |
| 2009/0282595 | A1 | 11/2009 | Branson et al. |
| 2009/0307878 | A1 | 12/2009 | Kadas |
| 2010/0235957 | A1 | 9/2010 | Dovner et al. |
| 2010/0313392 | A1 | 12/2010 | Anscher |
| 2011/0026123 | A1 | 2/2011 | Lee et al. |
| 2011/0072566 | A1 | 3/2011 | Kovacevich et al. |
| 2011/0113520 | A1 | 5/2011 | Dennis |
| 2011/0120295 | A1 | 5/2011 | Carter |
| 2011/0121043 | A1 | 5/2011 | Kincaid et al. |
| 2011/0162117 | A1 | 6/2011 | Schaffer et al. |
| 2011/0191933 | A1 | 8/2011 | Gregory et al. |
| 2012/0054993 | A1 | 3/2012 | Anscher |
| 2012/0167267 | A1 | 7/2012 | Osman |
| 2013/0185851 | A1 | 7/2013 | Nilsen et al. |

* cited by examiner

QUICK RELEASE BUCKLE

CLAIM OF PRIORITY

The present application is a continuation-in-part application of previously filed, pending application having Ser. No. 14/044,378, filed on Oct. 2, 2013 which matured into U.S. Pat. No. 9,038,251 on May 26, 2015 incorporated herein by reference.

BACKGROUND OF THE INVENTION

Field of the Invention

The present invention is directed to a quick release buckle assembly which may include a secondary release assembly as well as a quick release assembly, each of which is independently operable to facilitate the release of a belt end connector from a locked position. A gripping assembly preferably includes two locking segments movably connected and biased into confronting relation to one another in a manner which facilitates receipt of the belt connector therein in sandwiched relation there between to define the aforementioned locked position of the connector. Selective positioning of the quick release assembly facilitates a separation of the locking segments thereby enabling a quick and efficient removal of the belt connector from its locked position.

Description of the Related Art

Buckles of various types are known for use in many different applications, including but not limited to, clothing, sporting gear, luggage, safety equipment etc. In particular, buckle structures incorporating a quick release function are particularly useful in military gear, law enforcement apparel and scuba diving equipment.

Known two-part buckle assemblies are available in a variety of different constructions and typically include cooperating first and second buckle parts. One or both of the buckle parts of such known or conventional structures include interlocking components, which are cooperatively structured to accomplish the release or separation of the buckle parts. In more specific terms, a two-part buckle may typically include a female buckle component attached to one part of an article and a male connector attached to another part of the article. Further, the female component may be anchored to one end of a strap or belt, where in the male component is connected to the other end thereof. Typically, the female buckle component defines a substantially fixed chamber or pocket into which the mail component may be inserted. Various types of interlocking engagements are provided within the pocket of the female component of the buckle. Also in typical fashion, manipulation of at least one release structure serves to disconnect the inserted, mail component from the female component.

Buckles of the type set forth above have worked well for a variety of applications. However, in the use of buckles with military garments, law enforcement equipment, scuba diving, etc., it is necessary to have a release assembly associated with the buckle which accomplishes a quick release or separation of the male and female components. However, depending upon the structural and operative features of the buckle assembly and the environment or conditions under which a user or wearer is placed, a quick release of the buckle assembly and the resulting separation of the male and female parts from one another may be relatively time consuming and/or difficult to accomplish. Accordingly, quick release buckle assemblies are frequently not only a convenience but a necessity in certain applications and or lines of work. Further by way of example, outdoor enthusiasts, such as mountain climbers, rock climbers, hikers and the like may encounter a number of unusual and/or emergency situations in which it is desirable to release a belt, backpack, equipment, etc. in order to assure the safety or well-being of the wearer. In known or conventional buckle structures, such a quick release procedure may be difficult especially when the user is under stress or encounters the aforementioned emergency situations.

Therefore, there is a need in the art relating to buckle structures for a quick release buckle assembly capable of quickly and efficiently accomplishing a quick separation of the buckle from a belt connector or other connector structure. Moreover, such a preferred and proposed buckle assembly may also be equipped with an independently operable secondary release assembly, where in both the quick release belt assembly and the secondary release assemblies are operable to remove the belt connector from a locked position within the main housing or portion of the buckle assembly. In addition, a preferred and proposed buckle assembly may include a gripping assembly structured to removably retain the belt or like connector in a locked position by incorporating at least two locking segments movably connected or otherwise attached so as to be movable between a closed orientation any release orientation. As such, the quick release assembly may be selectively positioned and or manipulated to the extent of quickly and easily disposing the locking segments from the closed orientation into the release orientation by a separation thereof. Therefore, the quick release assembly associated with a preferred and proposed buckle assembly is selectively positionable into a separating engagement with the locking segments to at least partially define disposition of the locking segments from the closed orientation into the release orientation.

In addition, a preferred quick release buckle assembly should be structured to include sufficient structural and operative features to be used for a variety of different applications such as, but not limited to, the type set forth above. Also, the proposed buckle assembly may be made or constructed from a number of different materials all or at least some of which are sufficient to maintain a closed or locked position even under unusual conditions.

SUMMARY OF THE INVENTION

The present invention is directed to a buckle assembly typically, but not exclusively, intended for use in the removeable, quick release attachment of a belt or like gear, equipment, etc. commonly, but not exclusively, associated with the military, law enforcement and/or sports. As such, the buckle assembly is structured to accomplish a quick release which facilitates the quick and efficient removal of the attached gear, garment, etc. from a wearer, such as is sometimes required under emergency situations.

Accordingly, one or more preferred embodiments of the buckle assembly of the present invention includes a quick release assembly which provides for a detachment of the buckle assembly from a belt connector or other type connector used in combination with the buckle assembly as generally set forth above. As will be explained in greater detail hereinafter, the buckle assembly of the present invention may also include a secondary release assembly which is operable, independent of the quick release assembly, to detach the belt connector from its retained gripping engagement with a gripping assembly of the buckle assembly.

More specifically, the gripping assembly is structured to removably retain the connector in a locked position and includes at least two locking segments connected together in movable relation to one another. As such, the two locking segments are disposable between a closed orientation and a release orientation and may be accurately described as a jaw structure. The locked position of the connector includes the locking segments disposed in gripping engagement with the connector when in the closed orientation. Further, the gripping engagement comprises the connector retained in a substantial sandwiched relation between the locking segments. The quick release assembly is connected to the gripping assembly and is positionable into a separating engagement with and between the locking segments. When so positioned, the quick release assembly disposes the locking segments from the closed orientation into the separated, release orientation.

Each locking segment includes at least one, but in some structural modifications, a plurality of at least two grip members. Moreover, each of the one or more grip members on each of the locking segments is disposed in substantially aligned and/or correspondingly cooperative relation with one another so as to be normally biased into a substantially confronting relation with one another. As used herein the term "confronting relation" is meant to include actual confronting engagement or a minimal spacing between the correspondingly disposed grip members. Therefore, when in the closed orientation, the "confronting relation" of the grip members facilitates the aforementioned gripping engagement of the grip members with the connector, while the connector is disposed in a substantially sandwiched, retained relation between the locking segments.

The position of the belt connector between the locking segments and into the locked position is accomplished by the exertion of a "pushing force" on the belt connector to force it into the locked position through and between the grip members when they are in the confronting relation to one another. Accordingly, the one or more grip members associated with the locking segments are collectively disposed and structured to define an access opening there between. The access opening is dimensioned disposed and configured to facilitate the receipt of the belt connector there through into the locked position between the grip members and at least a portion of the remainder of the locking segments. The structural and operative features of the connected locking segments are such as to define a bias therein or there between. As a result the bias associated with the locking segments serves to normally maintain the locking segments in the closed orientation and the corresponding grip members in the aforementioned confronting relation to one another.

Additional structural and operative features of the quick release assembly include a head portion concurrently disposed into a sliding engagement with the locking segments upon a selective positioning of an elongated pull member associated with the quick release assembly. The elongated pull member extends outwardly from the locking segments and from the head portion. Therefore, the selective positioning of the pull member comprises a substantially outward force, directed away from the remainder of the buckle assembly.

In addition, an activating structure is formed on or connected to each of the locking segments. The activating structures are cooperatively disposed and structured with the head portion. As a result, the selective positioning of the pull member results in the aforementioned sliding engagement of the head portion with the activating structures and a concurrent separation of the locking segments from the closed orientation and out of a gripping engagement with the connector, into the release orientation. The activating structures further comprise a substantially convergent configuration cooperatively structured with the head portion to exert the sliding engagement there between and a resultant "wedging" action on said locking segments and a separation thereof into said release orientation. As a result the belt connector may be removed, quickly and efficiently, from its locked position between the locking segments.

As set forth above, one or more preferred embodiments of the buckle assembly of the present invention may also include a secondary release assembly independently operable to release the belt connector from its locked position between the locking segments. More specifically, the secondary release assembly may be mounted on and/or connected to a housing and or otherwise connected to the gripping assembly and include at least one, but preferably a pair of substantially oppositely disposed release members. The one or more release members are normally biased outwardly, in spaced relation to predetermined peripheral portions of the locking segments when the locking segments are in the closed orientation.

Moreover, the predetermined peripheral portions are dimensioned and configured to facilitate receipt of correspondingly disposed ones of the release members. As a result, the release members may be effectively "wedged" between the locking segments causing a separation thereof and their disposition from the closed orientation into the release orientation. Therefore and as described above predetermined manipulation of either the quick release assembly or the secondary release assembly will serve to dispose the locking segments into the release orientation and a removal of the connector from the locked position there between.

Other structural and operative features of the buckle assembly of the present invention include the cooperative structuring of the locking segments, specifically but not exclusively, including the grip members with the belt connector. The aforementioned locking position and/or gripping engagement of the locking segments and grip members with the belt connector may, in at least some practical applications, be defined by the grip members disposed in at least partially penetrating relation with cooperatively disposed and dimensioned apertures, openings and/or recesses formed in the belt connector. It is emphasized that a variety of differently structured belt connectors may be used in combination with the buckle assembly of the present invention. However, the belt connectors must be at least partially structured and dimensioned to establish the aforementioned gripping engagement and locked position of the connector between and relative to the locking segments in the manner described above and in greater detail hereinafter.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
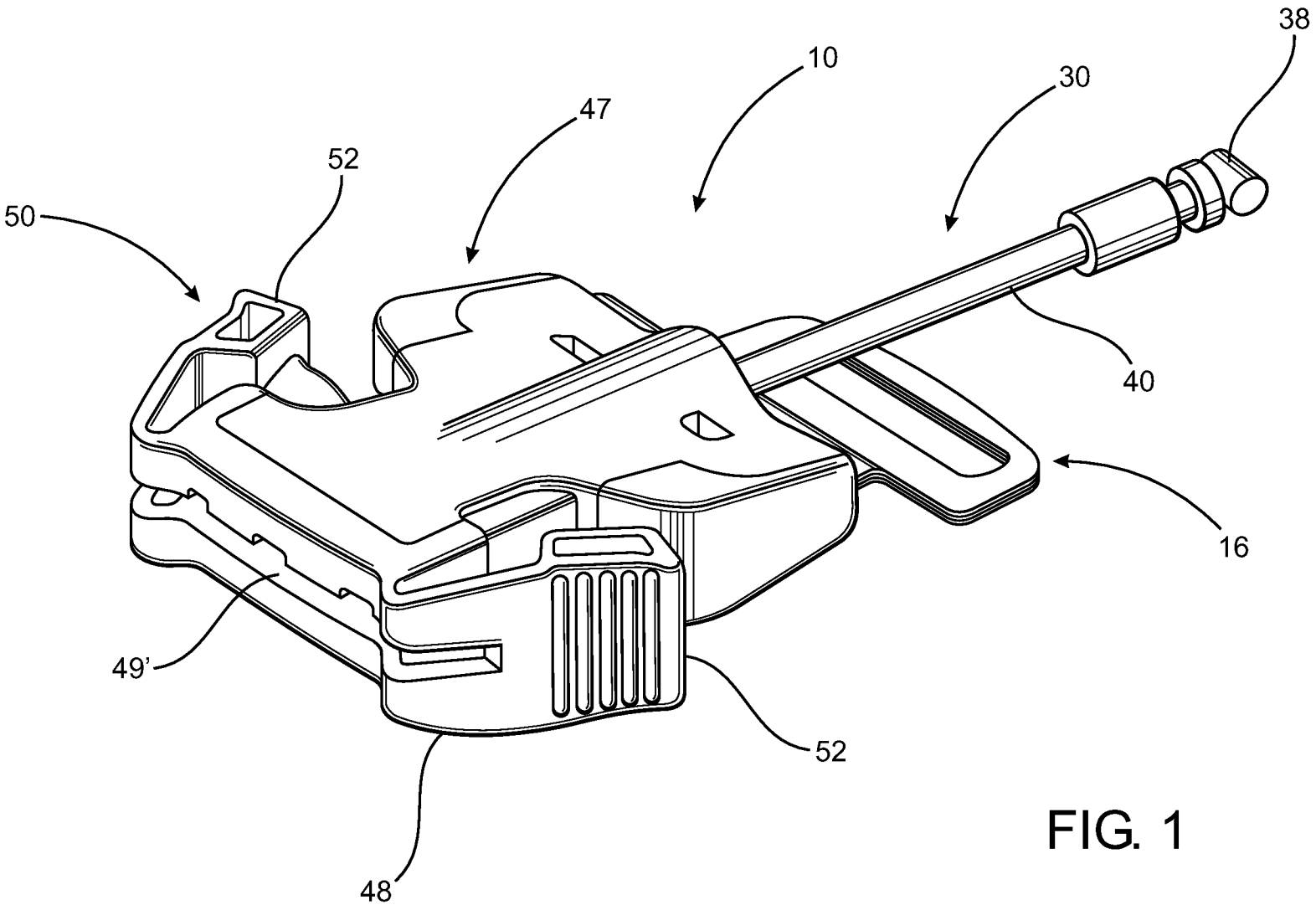
FIG. 1 is a perspective view of a quick release buckle assembly of the present invention.
Figure 2:
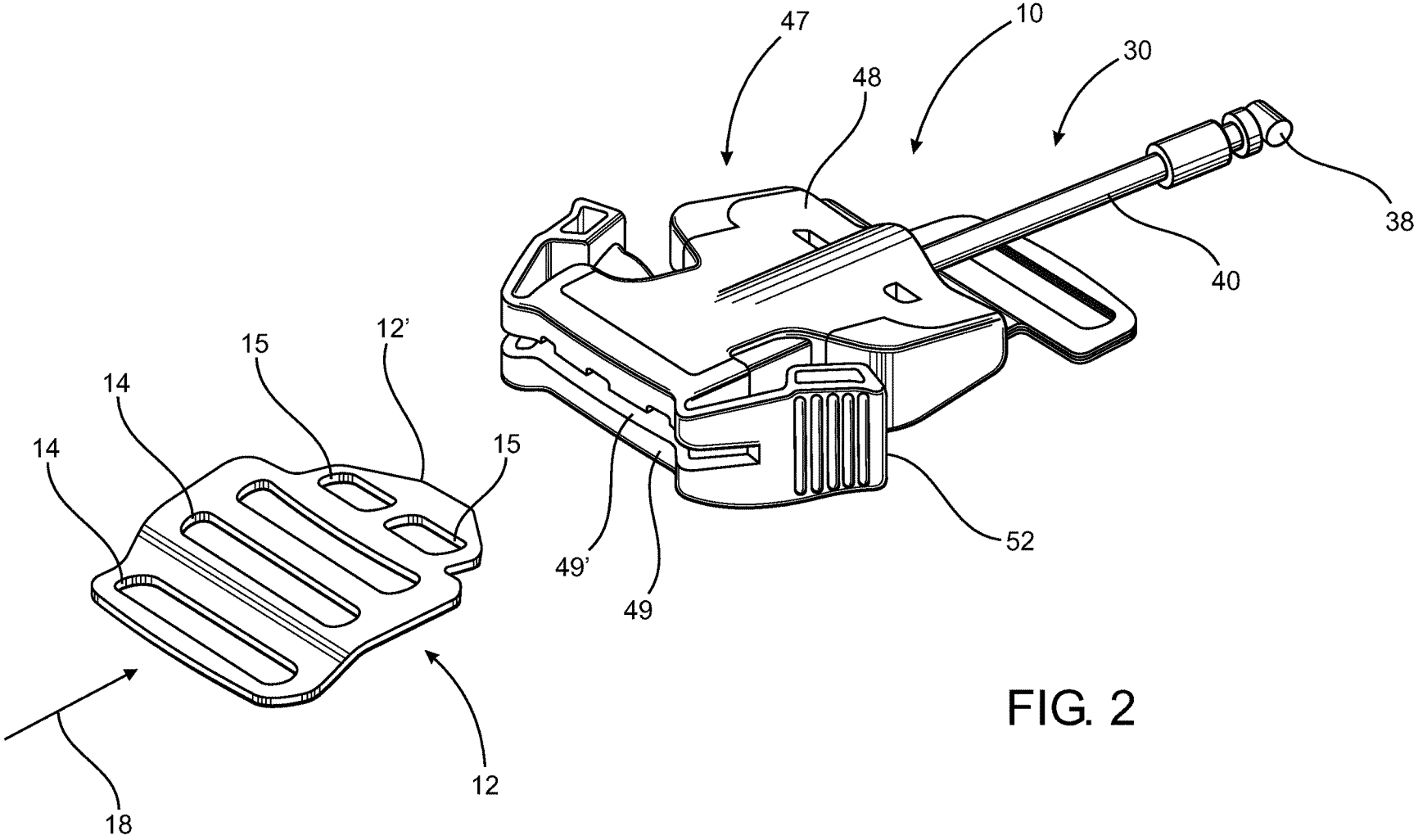
FIG. 2 is a perspective view in partially exploded form of the embodiment of FIG. 1 as used in combination with the belt connector.
Figure 3:
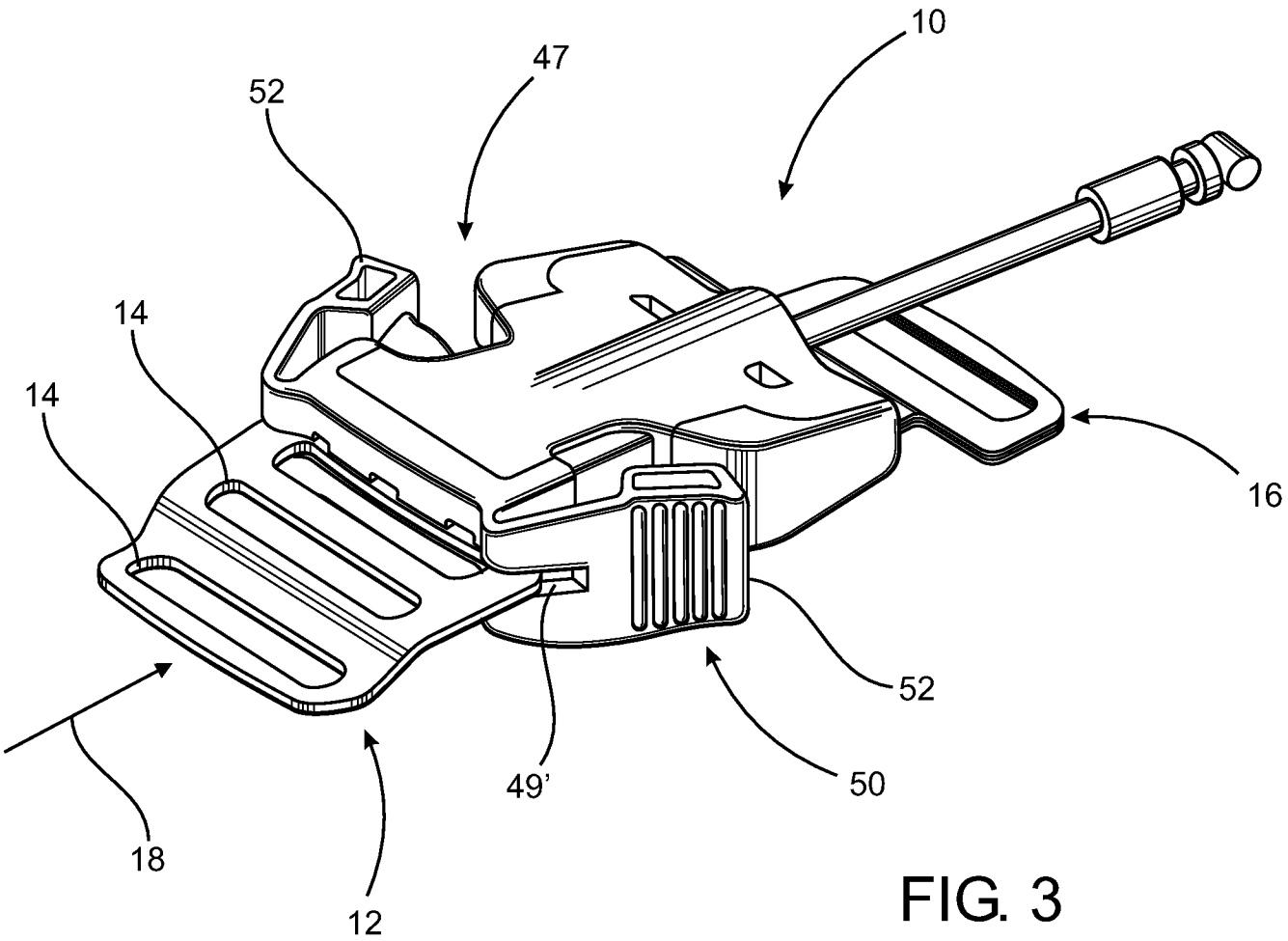
FIG. 3 is a perspective view of the embodiment of FIG. 2 in a connected and assembled state.

As represented in the accompanying Figures, the present invention is directed to a quick release buckle assembly represented in an assembled form and generally indicated as 10 in FIGS. 1-3.

As further represented in FIGS. 2 and 3, the buckle assembly 10 is structured to be used in combination with at least one and preferably a variety of different types of belt connectors generally indicated as 12. As such, the connector 12 may be attached to a belt or other type of article which facilitates the secure and stable mounting or positioning of equipment, garments, etc. on the body of a person or the like. Furthermore, the connector 12 may include one or more openings or like structuring, as at 14, to facilitate its attachment to an end of a belt or like member, as is well known especially, but not exclusively in the field of military equipment. In similar fashion, the buckle assembly 10 may also include appropriate structuring, as at 16, to facilitate its fixed or removable attachment to a belt or other equipment or garment portion with which the buckle assembly 10 is associated. Therefore, as practiced, the connector 12 may be forced into a "locked position" within the interior of the buckle 10 by directing a substantially "pushing" force thereon as schematically represented by directional arrow 18.

Figure 4:
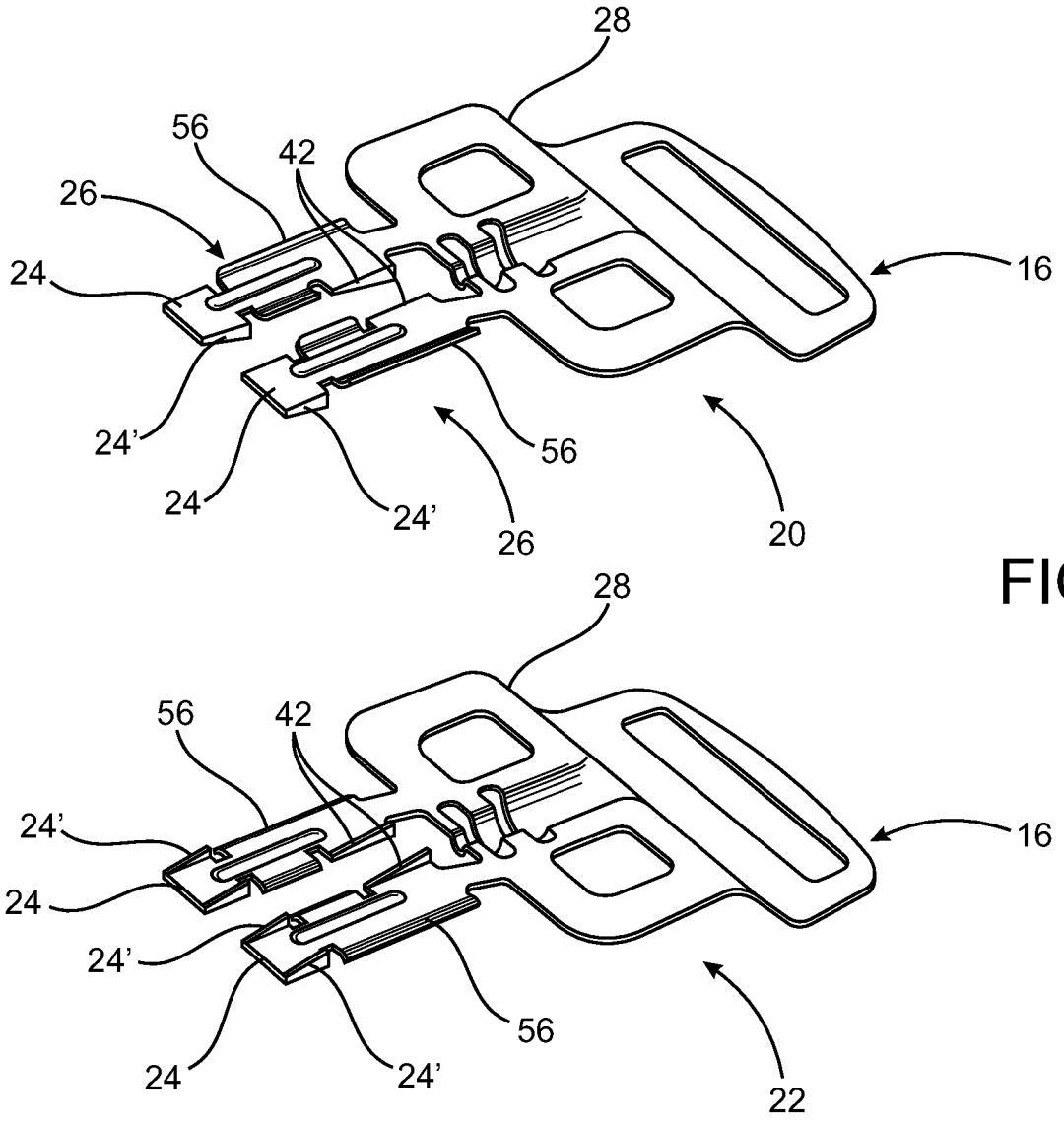
FIG. 4 is a perspective view of cooperatively structured locking segments associated with the buckle assembly of the present invention in an unassembled state.
Figures 5, 6:
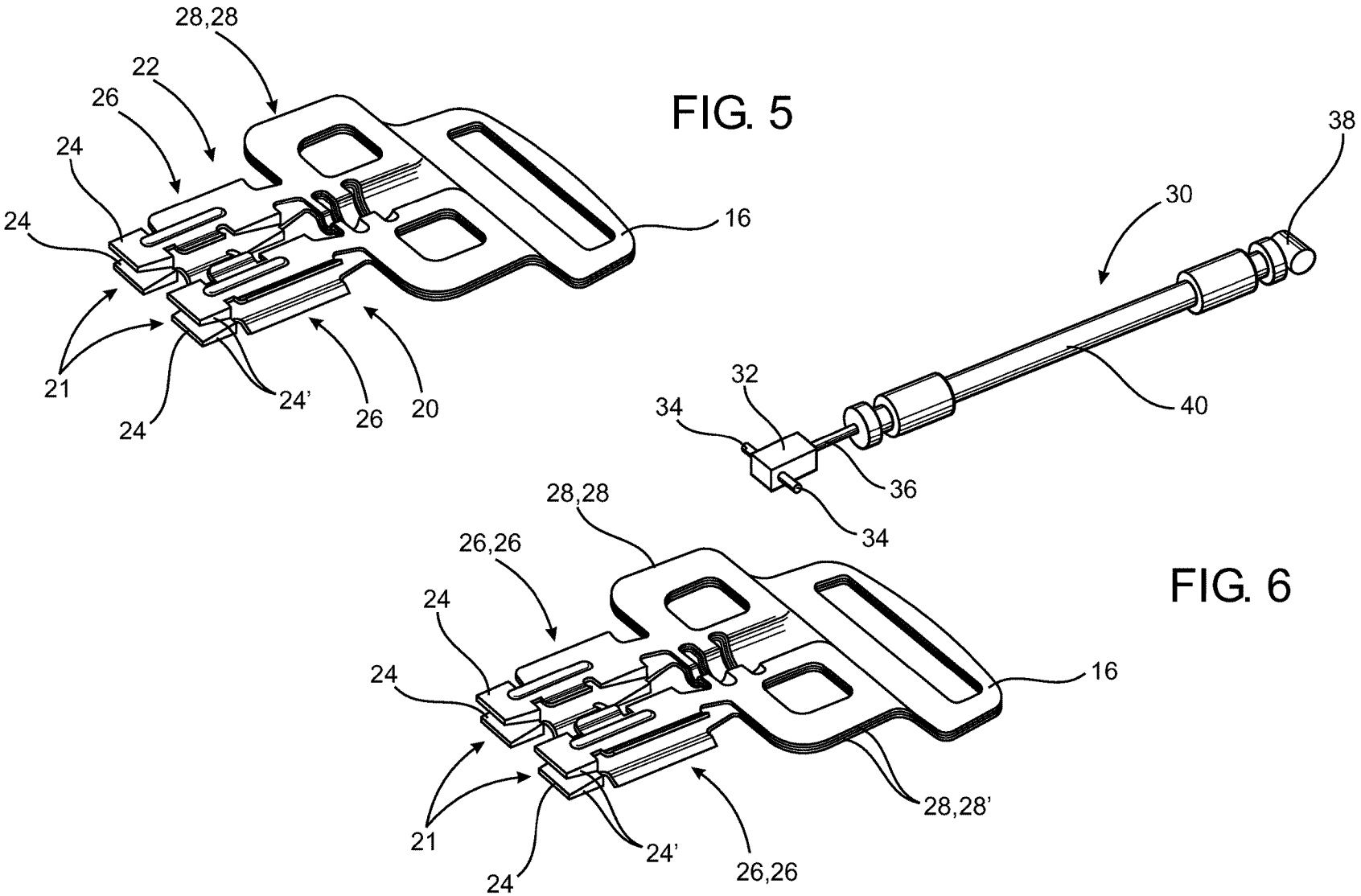
FIG. 5 is a perspective view of the embodiment of FIG. 4 in an assembled state.
FIG. 6 is a perspective view in partially exploded form of the embodiment of FIGS. 4 and 5 in combination with a quick release assembly in an unassembled state.

With additional reference to FIGS. 4-6, the buckle assembly 10 of the present invention also includes a plurality of at least two locking segments 20 and 22 which, as represented in FIGS. 5 and 6, may be connected together in an assembled state. In addition, each of the locking segments 20 and 22 includes at least one, but preferably a plurality of at least two grip members 24. Further, each of the grip members 24 may be formed on and/or at least partially define an elongated gripping structure 26 connected to a base portion 28 of each of the locking segments 20 and 22. Moreover, each of the gripping structures 26 may include an elongated configuration extending outwardly from the base 28 of the respective locking segments and be disposed in spaced and at least generally parallel relation to one another.

As represented in FIGS. 5 and 6, when the locking segments 20 and 22 are in the assembled state, the grip members 24 associated with each of the bases 28 are disposed in a substantially confronting relation to one another. As used herein, the term "confronting relation" is meant to include an actual confronting engagement between portions of each of the grip members 24 and/or a minimal spaced relation between corresponding or aligned portions of the grip members 24 of each of the gripping structures 26 of the locking segments 20 and 22. Additional features of the gripping structures 26 and more specifically the grip members 24 thereof, include the cooperative formation of the outer extremities or ends of the aligned and correspondingly positioned grip members 24. More specifically, the grip members 24 and/or the outer extremities thereof are spaced from one another into a substantially outwardly flared configuration and inwardly converging configuration. This spacing and/or flared configuration of aligned ones of the grip members 24 facilitate the receipt and passage of a leading portion 12' of the connector 12 through and between the grip members 24, as well and through and between the locking structures 26 of the connected locking segments 20 and 22.

The pushing force 18 exerted on the belt connector 12 will facilitate a wedging, separating action being forced on the grip members 24 and corresponding gripping structures 26 to cause their separation and the passage of the belt connector 12 there between into a "locked position" through what may be considered an access opening 21. Accordingly, the locked position of the connector 12 comprises a substantially sandwiched relation between the locking segments 20 and 22 and more specifically the locking structures 26 thereof. The locked position further comprises protruding portions 24' of the grip member 24 extending into, passing through or at partially penetrating or otherwise engaging and retaining correspondingly aligned portions of the connector 12 such as, but not limited to, the openings apertures or recesses 15 formed therein.

Additional structural and operative features of the buckle assembly 10 include a quick release assembly generally indicated as 30, as represented in at least FIGS. 6-10. As such, the quick release assembly 30 includes a head portion 32 including at least one but preferably two outwardly extending fingers 34 connected thereto in substantially opposing relation to one another. Further, the quick release assembly 30 includes an elongated pull member 36 connected at one end to the head portion 32 and including handle or like structure 38 connected to an outer or opposite end relative to the head 32. In addition, the quick release assembly 30 includes a sleeve or sheath member 40 disposed in surrounding at least partially enclosing relation to the elongated pull member 36 wherein the elongated member 36 and head portion 32 is movable relative to the sleeve or sheath 40. As clearly represented in FIGS. 7 and 8, the quick release assembly 30 is connected to the locking segments 20 and 22 when in their assembled state. As such, the outer sleeve or sheath 40 may be fixed to an appropriate recesses or indentation portion of the assembled locking segments 20 and 22 as disclosed. However, the head portion 32 is operatively connected in movable relation to the locking structures 26 in a manner that serves to establish a sliding, separating engagement of the fingers 34 of the head 32 with activating structures 42 (see FIG. 4) formed on each of the one or more griping structures 26 and associated with each of the locking segments 20 and 22.

As clearly represented in FIG. 4, when the locking segments 20 and 22 are in the assembled state, correspondingly disposed locking structures 42 associated with each of the plurality of gripping structures 26 are disposed to collectively define a substantially inwardly convergent slope or wedge like configuration. Further, the aforementioned fingers 34 associated with the head 32 are disposed between the aligned and/or correspondingly disposed activating structures 42. As a result, the quick release of the buckle assembly 10 from the corresponding connector 12, when in its locked position, is accomplished by selectively positioning the pull member 36 by exerting an outward pulling force thereon in a direction substantially away from the locking segments 20 and 22, as well as the remainder of the buckle assembly 10. Such a pulling force and/or selective positioning of the pull member 36 will result in sliding engagement of the head 32 and more specifically fingers 34 with and between activating structures 42. As a result, a separating, "wedging action" will be exerted on the activating structures 42 and corresponding ones of the gripping structures 26. This "wedding action" or force will cause a separation of the gripping structures 26 and grip members 24 thereby positioning the gripping structures 26 from the normally closed orientation into the release orientation due to the separation of the gripping structures 26. Once in the separated, release orientation, the connector 12 may be removed from its substantially sandwiched, locked position between the locking segments 20 and 22 and more specifically the gripping structures 26 and grip members 24 associated therewith.

Figure 7:
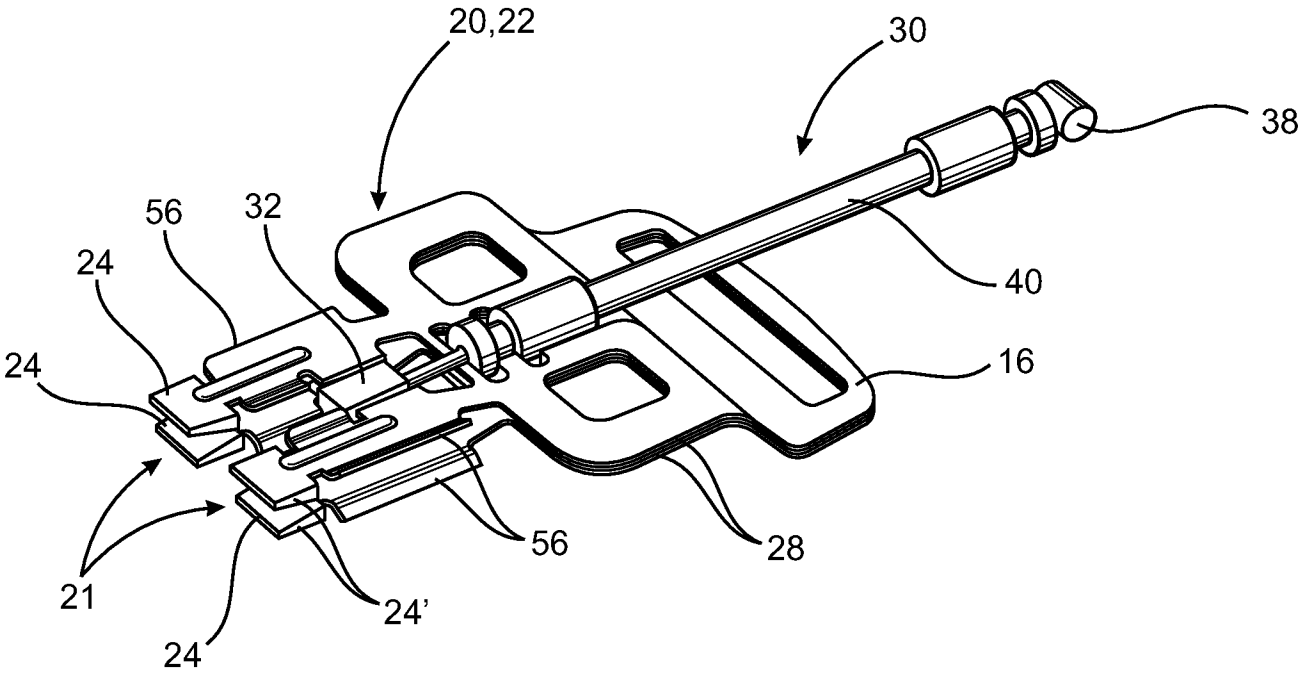
FIG. 7 is a perspective view of the embodiment of FIG. 6 in an assembled state.
Figure 8:
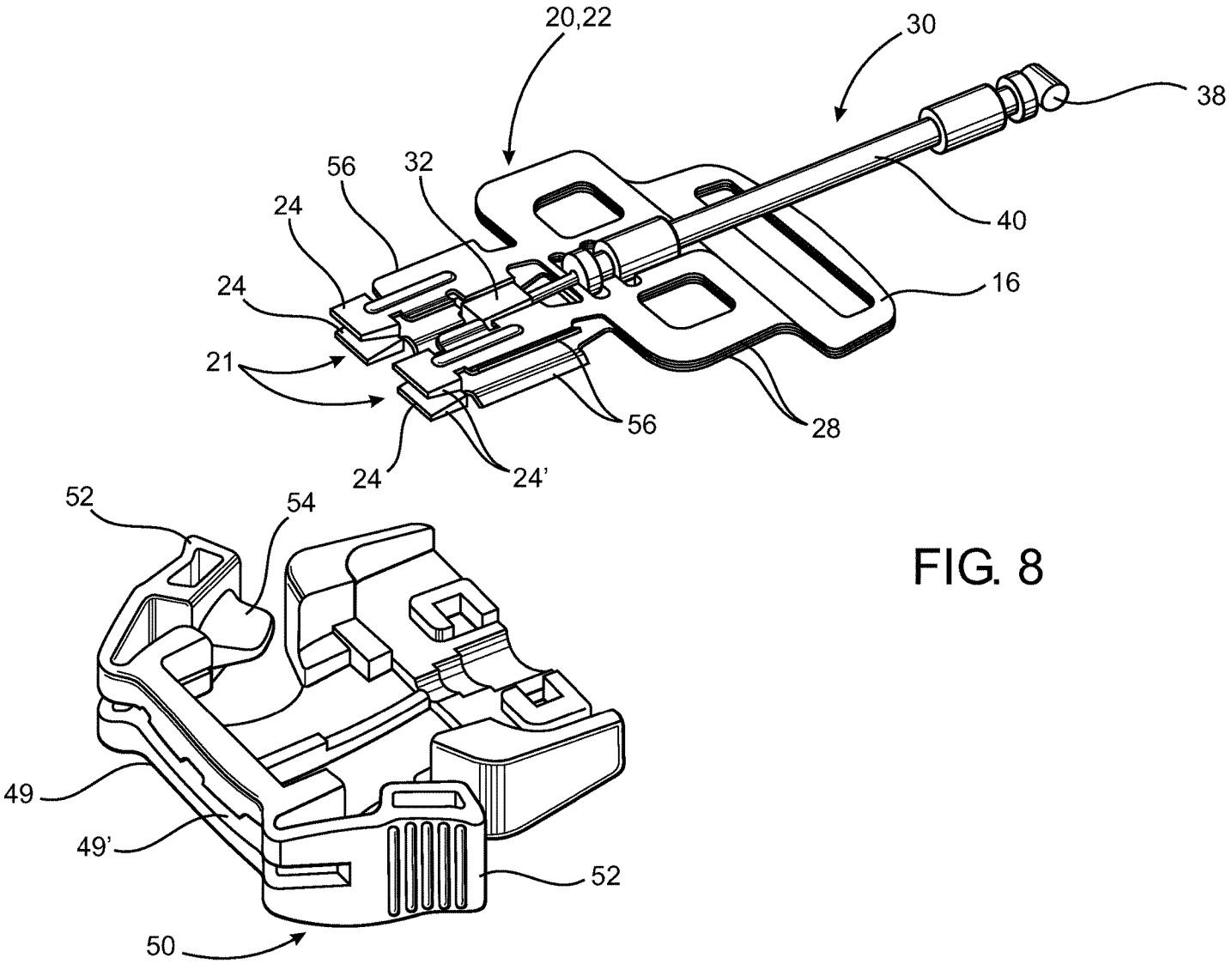
FIG. 8 is a perspective view in partially exploded form of the embodiment of FIG. 7 in combination of a portion of a housing of the buckle assembly of the present invention in an unassembled state.
Figure 9:
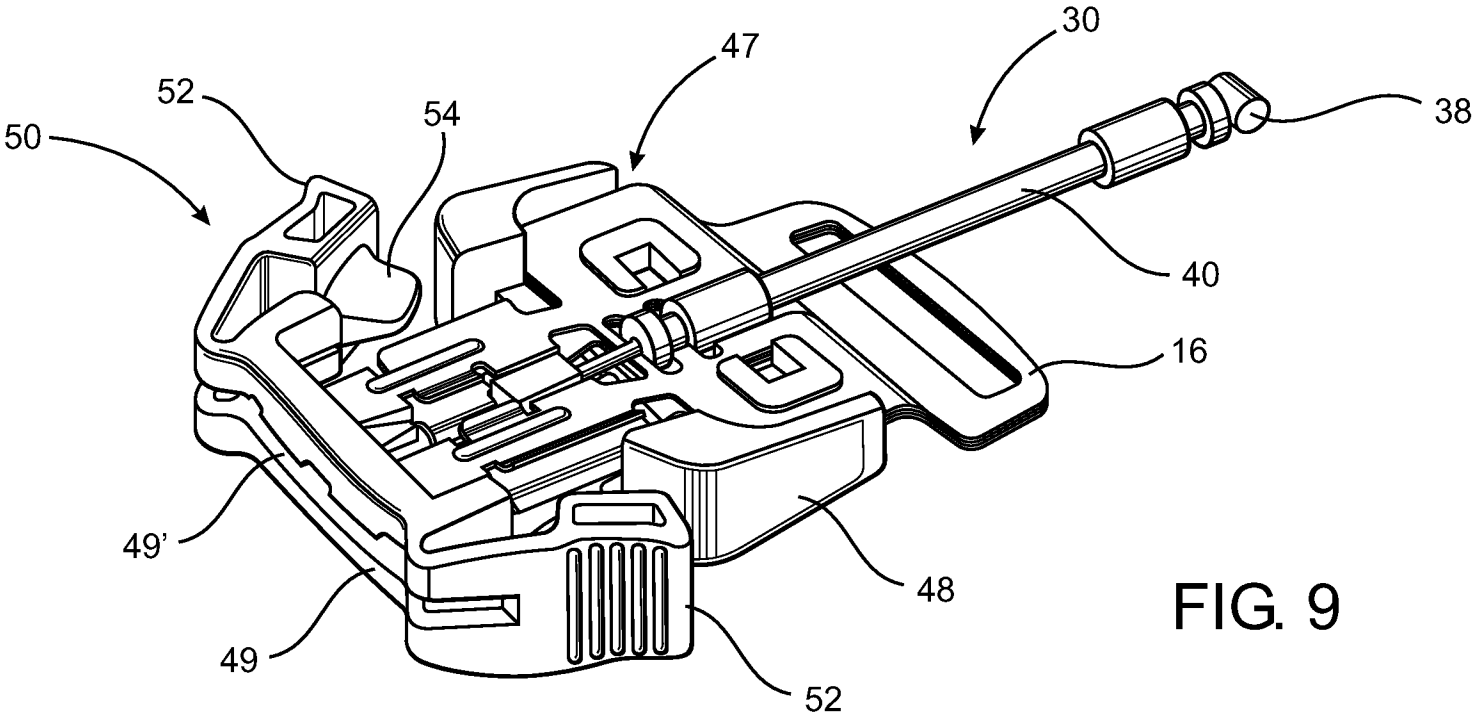
FIG. 9 is a perspective view of the embodiment of FIG. 8 in an assembled state.
Figure 10:
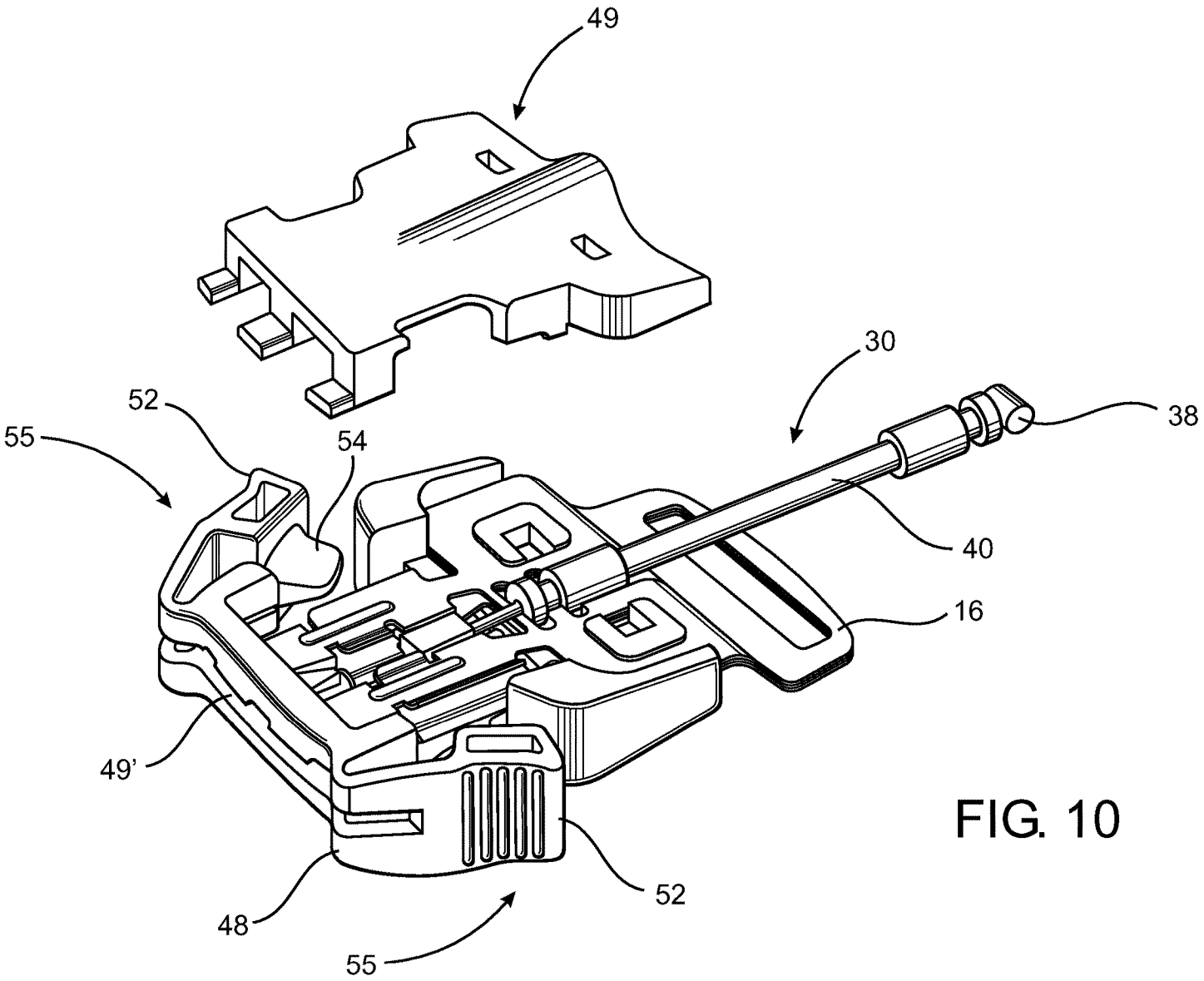
FIG. 10 is a perspective view in partially exploded form of the embodiment of FIG. 9 with an initial portion of the housing in an unassembled state.

Yet another feature of at least one preferred embodiment of the present invention is the provision of a secondary release assembly generally indicated as 50. The secondary release assembly 50 is connected to or integrally formed on housing 47, or at least a portion thereof. More specifically, the secondary release assembly 50 includes at least one but preferably a pair of release members 52 flexibly connected to a portion 48 of the housing 47 in a manner which defines a substantially outwardly biased disposition of the one or more release members 52 relative to the locking segments 20 and 22 and at least some of the housing portion 48. As represented in FIGS. 9 and 10, each release member 52 includes a release segment 54 also having a substantially wedged configuration defined by outwardly convergent protrusions. As a result, the outermost portions of the release segments or protrusions 54 are sufficiently narrow to engage and pass between and within predetermined and corresponding peripheral portions 56 of the locking segments 20 and 22. When in the assembled state as represented in FIGS. 7 and 8, the predetermined peripheral portions 56 collectively define an outwardly flared configuration. Moreover, the predetermined peripheral portions 56, including the outwardly flared configurations, thereof, are dimensioned to facilitate the passage of the wedge like release segments 54 there through when an inwardly directed force is exerted on the release segments 54, such as by the fingers of a user. For purposes of clarity, the inwardly directed force exerted on the release members 52 is schematically represented as 55. Passage of the wedge like protrusions of the release segments 54 through the flared, predetermined peripheral portions 56 will cause a separation of the corresponding locking structures 26, associated with each of the locking segments 20 and 22. In turn, the locking structures 26 and associated locking segments 20 and 22, as well as corresponding ones of the grip members 24, will be forced to separate from the closed orientation into the separated release orientation. Once in the release orientation, the connector 12 will thereby be easily removed from its locked position in sandwiched relation between the gripping structure 26 of corresponding ones of the locking segments 20 and 22.

As shown in FIGS. 1 through 3 and 10, additional segments or portions of the housing as at 49 may then be attached to the remainder of buckle assembly 10 including housing portion 48, and connected locking segment 20 and 22 with the quick release assembly 30 operatively mounted thereon. It is further noted that the housing portion also includes an opening 49' disposed in aligned relation with the access opening 21 defined by the outwardly flared, inwardly converging grip members 24.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A buckle assembly structured for quick release of an associated connector, said buckle assembly comprising:

a gripping assembly structured to removably retain the connector in a locked position, said gripping assembly comprising at least two locking segments movable relative to one another between a closed orientation and a release orientation, said locking segments structured to engage said connector when in said closed orientation and thereby retain the connector in said locked position, a quick release assembly connected to said gripping assembly, said quick release assembly positionable into a separating engagement with said locking segments to at least partially define disposition of said locking segments from said closed orientation into said release orientation, a secondary release assembly connected to said gripping assembly and including at least one release member disposable between a rest position and a release position, said release position comprising a separating engagement of said at least one release member between said locking segments, said locking segments including peripheral portions defining an outwardly flared opening structured and disposed to receive said release member there through into said separating engagement between said locking segments, and said rest position comprising said at least one release member normally biased outwardly, in spaced relation to said peripheral portions of said locking segments.

2. A buckle assembly as recited in claim 1 wherein each of said locking segments include at least one grip member, said grip members collectively disposed in said gripping engagement with the connector when in said closed orientation.

3. A buckle assembly as recited in claim 2 wherein said grip members protrude outwardly from corresponding ones of said locking segments, into an aligned relation to apertures of the connector when in said closed orientation, to further define said gripping engagement.

4. A buckle assembly as recited in claim 2 wherein said grip members are collectively disposed and structured to define an access opening between said locking segments, said access opening dimensioned and disposed to receive the connector there through into said locked position between locking segments.

5. A buckle assembly as recited in claim 4 wherein said access opening comprises an outwardly flared configuration structured to facilitate sliding, separating engagement of the connector with said grip members and between corresponding ones of said locking segments.

6. A buckle assembly as recited in claim 1 wherein said locking segments are connected into a biased, confronting relation to one another, to at least partially define said closed orientation.

7. A buckle assembly as recited in claim 6 wherein said locking segments collectively define a jaw structure, said jaw structure normally biased into said closed orientation and being at least partially separable into said release orientation, at least upon selective positioning of said quick release assembly.

8. A buckle assembly as recited in claim 6 wherein said quick release assembly comprises a head portion concurrently disposable into said sliding engagement with said two locking segments upon a selective positioning of a remainder of said release assembly.

9. A buckle assembly as recited in claim 8 wherein said quick release assembly comprises an elongated pull member connected to said head portion, said pull member movably disposed on said gripping assembly and extending outwardly therefrom, said selective positioning comprising an outwardly directed force exerted on said pull member in a direction away said gripping assembly.

10. A buckle assembly as recited in claim 8 further comprising an activating structure disposed on each of said locking segments, said head portion disposed in said separating engagement with said activating structures upon said selective positioning of said quick release assembly.

11. A buckle assembly as recited in claim 10 wherein activating structures collectively comprise a substantially convergent configuration cooperatively disposed and structured with said head portion to exert a sliding engagement of said head portion on said activating structures and a concurrent separation of said locking segments into said release orientation.

12. A buckle assembly as recited in claim 1 wherein said quick release assembly further comprises a head portion and an elongated pull member connected to said head portion, said head portion disposed in sliding engagement with said locking segments upon a selective positioning of said pull member, said pull member moveably disposed on said gripping assembly and extending outwardly therefrom, said selective positioning of said pull member comprising an outwardly directed force exerted thereon in a direction away from said gripping assembly.

13. A buckle assembly as recited in claim 12 further comprising activating structures disposed on said locking segments, said head portion disposed in said separating engagement with said activating structures upon said selective positioning of said pull member.

14. A buckle assembly as recited in claim 13 wherein said activating structures collectively comprise a substantially convergent configuration cooperatively disposed and structured with said head portion to exert a sliding engagement of said head portion there between and a separation thereof into said release orientation.

15. A buckle assembly structured for quick release of an associated connector, said buckle assembly comprising:

at least two locking segments movable relative to one another between a closed orientation and a release orientation, said locking segments structured to retain the connector in a locked position when said locking segments are disposed in said closed orientation, a quick release assembly positionable into a separating engagement with said locking segments to at least partially define disposition of said locking segments from said closed orientation into said release orientation, and a secondary release assembly including at least two release members concurrently disposable between a rest position and a release position, said release position comprising a separating engagement of said release members between said locking segments, and said rest position comprising an outwardly spaced relation of said release members relative to substantially oppositely disposed peripheral portions of said locking segments, at least when said locking segments are in said closed orientation.

16. A buckle assembly as recited in claim 15 wherein each of said oppositely disposed peripheral portions comprises an outwardly flared opening dimensioned and configured to facilitate receipt of a correspondingly disposed of one of said release members there through and between said locking segments.

17. A buckle assembly as recited in claim 15 wherein said locking segments comprise a gripping assembly, said gripping assembly including a housing connected thereto; said release members movably connected to said housing in an outwardly biased relation to said locking segments when said release members are in said rest position.

18. A buckle assembly as recited in claim 17 wherein said release members are integrally and flexibly connected to said housing and removably attached, with said housing, to said gripping assembly.

* * * * *